US009328298B2

(12) United States Patent
Funk et al.

(10) Patent No.: US 9,328,298 B2
(45) **Date of Patent: *May 3, 2016**

(54) NAPHTHA CRACKING

(71) Applicant: UOP LLC, Des Plaines, IL (US)

(72) Inventors: Gregory A. Funk, Carol Stream, IL (US); Mary Jo Wier, Schaumburg, IL (US)

(73) Assignee: UOP LLC, Des Plaines, IL (US)

( * ) Notice: Subject to any disclaimer, the term of this patent is extended or adjusted under 35 U.S.C. 154(b) by 179 days.

This patent is subject to a terminal disclaimer.

(21) Appl. No.: 14/271,392

(22) Filed: May 6, 2014

(65) Prior Publication Data

US 2014/0357913 A1 Dec. 4, 2014

Related U.S. Application Data

(60) Provisional application No. 61/830,964, filed on Jun. 4, 2013.

(51) Int. Cl.

| | |
|---|---|
| ***C07C 4/04*** | (2006.01) |
| ***C07C 4/06*** | (2006.01) |
| ***C10G 35/24*** | (2006.01) |
| ***C10G 69/08*** | (2006.01) |
| ***C10G 69/00*** | (2006.01) |
| ***C10G 69/04*** | (2006.01) |
| ***C10G 69/06*** | (2006.01) |

(52) U.S. Cl.

CPC ..... *C10G 69/08* (2013.01); *C10G 69/00* (2013.01); *C10G 69/04* (2013.01); *C10G 69/06* (2013.01); *C10G 2400/20* (2013.01); *C10G 2400/30* (2013.01)

(58) Field of Classification Search

CPC ..... C07C 4/04; C07C 4/06; C10G 35/24
USPC ..... 585/330, 319, 648, 653, 652; 208/133
See application file for complete search history.

(56) References Cited

U.S. PATENT DOCUMENTS

| | | | |
|---|---|---|---|
| 5,026,935 | A | 6/1991 | Leyshon |
| 5,026,936 | A | 6/1991 | Leyshon |
| 5,043,522 | A | 8/1991 | Leyshon |
| 2006/0100473 | A1 | 5/2006 | Grootjans |
| 2010/0155300 | A1 | 6/2010 | Sabottke |
| 2010/0300932 | A1 | 12/2010 | Debuisschert |

FOREIGN PATENT DOCUMENTS

| | | | |
|---|---|---|---|
| CN | 101368111 | B | 4/2013 |
| EP | 109060 | B1 | 3/1987 |
| EP | 109059 | B1 | 7/1987 |
| WO | 2007043738 | A1 | 4/2007 |

OTHER PUBLICATIONS

Kaiser, "Better ethylene separation unit", Hydrocarbon Processing, Nov. 1988, pp. 57-61.
U.S. Appl. No. 14/271,399, Funk, filed May 6, 2014.
PCT International Search Report for PCT/US2014/038870 dated Oct. 16, 2014.

*Primary Examiner* — Thuan D Dang

(57) ABSTRACT

A process for increasing the yields of light olefins and the yields of aromatics from a hydrocarbon stream is presented. The process includes a first separation to direct the light components that are not reformable to a cracking unit, with the remainder passed to a second separation unit. The second separation unit extracts normal components from the hydrocarbon stream to pass to the cracking unit. The resulting hydrocarbon stream with reduced light ends and reduced normals is passed to a reforming unit.

4 Claims, 1 Drawing Sheet

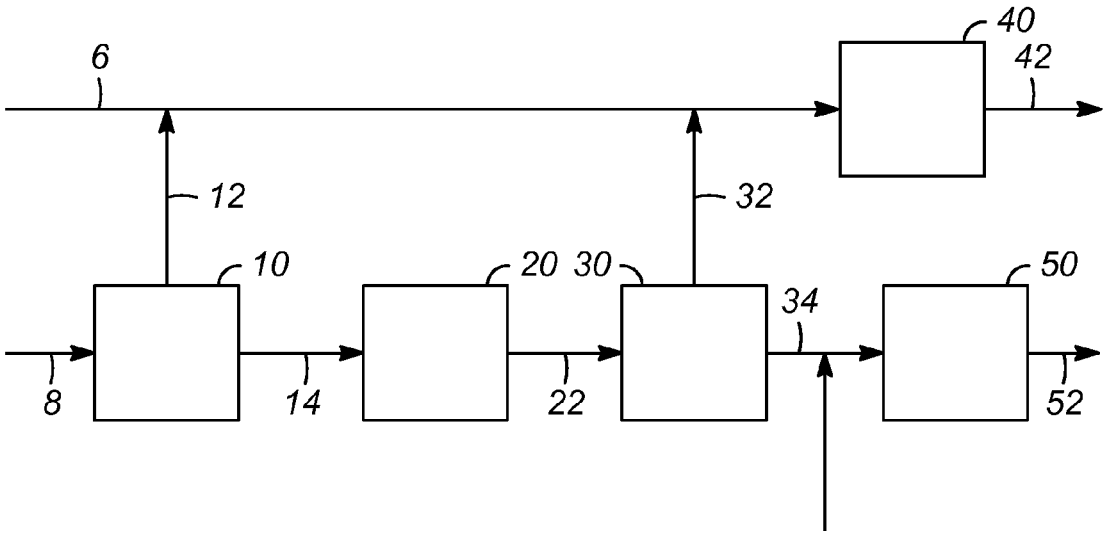
6
40
42
12
32
10
20
30
34
50
8
14
22
52

NAPHTHA CRACKING

CROSS REFERENCE TO RELATED APPLICATION

This application claims the benefit of U.S. Provisional Application No. 61/830,964 filed on Jun. 4, 2013.

FIELD OF THE INVENTION

The present invention relates to a process for the production of light olefins from a naphtha feed stream. This invention also relates to an improved process for increasing the yields of light olefins.

BACKGROUND OF THE INVENTION

Ethylene and propylene, light olefin hydrocarbons with two or three atoms per molecule, respectively, are important chemicals for use in the production of other useful materials, such as polyethylene and polypropylene. Polyethylene and polypropylene are two of the most common plastics found in use today and have a wide variety of uses for both as a material fabrication and as a material for packaging. Other uses for ethylene and propylene include the production of vinyl chloride, ethylene oxide, ethylbenzene and alcohol. Steam cracking or pyrolysis of hydrocarbons produces essentially all of the ethylene and propylene. Hydrocarbons used as feedstock for light olefin production include natural gas, petroleum liquids, and carbonaceous materials including coal, recycled plastics or any organic material.

An ethylene plant is a very complex combination of reaction and gas recovery systems. The feedstock is charged to a cracking zone in the presence of steam at effective thermal conditions to produce a pyrolysis reactor effluent gas mixture. The pyrolysis reactor effluent gas mixture is stabilized and separated into purified components through a sequence of cryogenic and conventional fractionation steps. A typical ethylene separation section of an ethylene plant containing both cryogenic and conventional fractionation steps to recover an ethylene product with a purity exceeding 99.5% ethylene is described in an article by V. Kaiser and M. Picciotti, entitled, "Better Ethylene Separation Unit." The article appeared in HYDROCARBON PROCESSING MAGAZINE, November 1988, pages 57-61 and is hereby incorporated by reference.

Methods are known for increasing the conversion of portions of the products of the ethylene production from a zeolitic cracking process to produce more ethylene and propylene by a disproportionation or metathesis of olefins. Such processes are disclosed in U.S. Pat. Nos. 5,026,935 and 5,026,936 wherein a metathesis reaction step is employed in combination with a catalytic cracking step to produce more ethylene and propylene by the metathesis of $C_4$ and heavier molecules. The catalytic cracking step employs a zeolitic catalyst to convert a hydrocarbon stream having 4 or more carbon atoms per molecule to produce olefins having fewer carbon atoms per molecule. The hydrocarbon feedstream to the zeolitic catalyst typically contains a mixture of 40 to 95 wt-% paraffins having 4 or more carbon atoms per molecule and 5 to 60 wt-% olefins having 4 or more carbon atoms per molecule. In U.S. Pat. No. 5,043,522, it is disclosed that the preferred catalyst for such a zeolitic cracking process is an acid zeolite, examples includes several of the ZSM-type zeolites or the borosilicates. Of the ZSM-type zeolites, ZSM-5 was preferred. It was disclosed that other zeolites containing materials which could be used in the cracking process to produce ethylene and propylene included zeolite A, zeolite X, zeolite Y, zeolite ZK-5, zeolite ZK-4, synthetic mordenite, dealuminized mordenite, as well as naturally occurring zeolites including chabazite, faujasite, mordenite, and the like. Zeolites which were ion-exchanged to replace alkali metal present in the zeolite were preferred. Preferred cation exchange cations were hydrogen, ammonium, rare earth metals and mixtures thereof.

European Patent No. 109,059B1 discloses a process for the conversion of a feedstream containing olefins having 4 to 12 carbon atoms per molecule into propylene by contacting the feedstream with a ZSM-5 or a ZSM-11 zeolite having a silica to alumina atomic ratio less than or equal to 300 at a temperature from 400 to 600° C. The ZSM-5 or ZSM-11 zeolite is exchanged with a hydrogen or an ammonium cation. The reference also discloses that, although the conversion to propylene is enhanced by the recycle of any olefins with less than 4 carbon atoms per molecule, paraffins which do not react tend to build up in the recycle stream. The reference provides an additional oligomerization step wherein the olefins having 4 carbon atoms are oligomerized to facilitate the removal of paraffins such as butane and particularly isobutane which are difficult to separate from $C_4$ olefins by conventional fractionation. In a related European Patent 109060B1, a process is disclosed for the conversion of butenes to propylene. The process comprises contacting butenes with a zeolitic compound selected from the group consisting of silicalites, boralites, chromosilicates and those zeolites ZSM-5 and ZSM-11 in which the mole ratio of silica to alumina is greater than or equal to 350. The conversion is carried out at a temperature from 500 to 600° C. and at a space velocity of from 5 to 200 kg/hr of butenes per kg of pure zeolitic compound. The European Patent 109060B1 discloses the use of silicalite-1 in an ion-exchanged, impregnated, or co-precipitated form with a modifying element selected from the group consisting of chromium, magnesium, calcium, strontium and barium.

Generally, the heavier olefins having six or more carbon atoms per molecule which are produced in commercial ethylene plants are useful for the production of aromatic hydrocarbons. Portions of the olefin product include olefins with four carbon atoms per molecule. This portion includes both mono-olefins and di-olefins and some paraffins, including butane and iso-butane. Because the portion with four carbon atoms per molecule is generally less valuable and requires significant processing to separate di-olefins from the mono-olefins, processes are sought to improve the utilization of this portion of the ethylene plant product and enhancing the overall yield of ethylene and propylene.

It is difficult in naphtha cracking to obtain high selectivity to ethylene and propylene, while maintaining high conversion. Improvements in catalysts and processes that accomplish this are therefore desirable.

SUMMARY OF THE INVENTION

The present invention provides for a process to optimize and improve the yields of light olefins and aromatics. The process includes passing a hydrocarbon stream to a first separation unit to generate a first light stream and a first heavy stream. The first light stream is made up of hydrocarbon components that are light ends, and are not readily reformable, but that can readily be cracked in a cracking reactor to generate light olefins. The first heavy stream is passed to a hydrotreating unit to remove residual sulfur compounds and nitrogen compounds, and generates a treated heavy stream. The heavy stream is passed to a second separation unit to produce an extract stream comprising the normal hydrocarbons from the heavy hydrocarbon stream. The separation unit also generates a raffinate stream comprising the non-normal components of the heavy hydrocarbon stream. The process further includes passing the first light stream and the extract stream to a cracking unit to generate a light olefin product stream. The process includes passing the raffinate stream to a reforming unit to generate a reformate process stream comprising aromatics.

The cracking unit can be a steam cracker, or a catalytic naphtha cracker, with the hydrocarbon stream comprising a straight run naphtha. In one embodiment, the first light stream includes C5-hydrocarbons, and some C6 hydrocarbons. The cut for the first separation column includes sending hexanes, methyl cyclopentane, methylpentanes and dimethylbutanes in the first light stream.

Other objects, advantages and applications of the present invention will become apparent to those skilled in the art from the following detailed description and drawings.

BRIEF DESCRIPTION OF THE DRAWING

The FIGURE is a process flow for increasing yields of light olefins from a naphtha cracker.

DETAILED DESCRIPTION OF THE INVENTION

The production of light olefins is generated from the cracking of heavier hydrocarbons using cracking units. The cracking units are designed for targeted flow rates to convert a hydrocarbon feedstream. The yields can be changed, or increased, by controlling the feedstream makeup, or its content. By manipulating the feedstream content, the yields from a cracking unit can be increased. In addition, the production of aromatics for feed to an aromatics complex can also be increased by controlling the feedstream makeup to reforming units in the conversion of non-aromatic constituents to aromatic constituents. The process of the present invention concerns the optimization of operating a cracking unit and a reforming unit, where the feed to each unit is held substantially constant. In one embodiment, the process utilizes a straight run naphtha feedstream to be split and passed to the two units. As use hereinafter, a straight run naphtha feedstream is meant to include a full boiling range naphtha feedstream. The process provides for the conversion of a relatively low value naphtha feedstream into higher value products such as light olefins and aromatic compounds.

While to present invention is aimed at optimizing the yields of the two process units, a cracking unit and a catalytic reforming unit, the process can also be used to improve the yields of each individual unit. Hydrocarbon streams comprise a complex mixture. The first separation process is typically around boiling points, where cuts are made on boiling point ranges. Other means of separation are also employed downstream to pull out specific classes of hydrocarbons.

It has been found that more intricate separations of the hydrocarbon streams can increase yields for downstream process units, while maintaining substantially constant flow rates to the downstream processing units. A typical feedstream to a cracking unit, and a reforming unit is a straight run naphtha feedstream. But it is intended that other feedstreams can be used for this process, and as used hereinafter, the term naphtha feedstream is meant to encompass other potential hydrocarbon feedstreams that can be used in cracking and reforming.

In one embodiment of the present process, a naphtha feedstream is passed to a cracking unit to generate light olefins. As shown in FIG. 1, the process for producing light olefins includes passing a hydrocarbon feedstream 8 to a first separation column 10. The column 10 generates a first light stream 12 and a first heavy stream 14. The first heavy stream 14 is passed to a hydrotreating unit 20 to generate a treated heavy stream 22. The treated heavy stream 22 is passed to a second separation unit 30 to generate a first extract stream 32 and a raffinate stream 34. The first extract stream 32 comprises normal hydrocarbons, and the raffinate stream 34 comprises non-normal hydrocarbons. The first extracts stream 32 and the first light stream 12 are passed to a cracking unit 40 to generate light olefins. The cracking unit 40 can be a stream cracker, or a catalytic naphtha cracking unit.

The first light stream 12 can comprise C5-hydrocarbons, and is a separation of the light hydrocarbons from the straight run naphtha stream. It was found that C6 compounds, such as methyl cyclopentane are more difficult to reform, and therefore it was found to be advantageous to pass operate the first separation column 10 to include sending some C6 compounds, including methyl cyclopentane, out with the overhead stream 12. The heavy stream 14 can comprise C7 and heavier components, and some C6 components that are readily reformed, such as cyclohexane.

The second separation unit 30 is preferably an adsorption-separation unit, and the separation is controlled by the choice of adsorbent and desorbent. For the present process, the second separation unit 30 is designed for separating normal hydrocarbons in the C5 to C11 range from the treated heavy stream 22. The normal hydrocarbons are separated and sent out in the extract stream 32, with a raffinate stream 34 comprising non-normal hydrocarbons. The desorbent for the preferred process is a normal C12 paraffin.

The raffinate stream 34 can be passed to a reforming unit 50 to generate a process stream 52 comprising aromatics. The process stream 52 can be passed to an aromatics complex for conversion to higher value products.

In one embodiment, the process includes increasing the yields of aromatics from the catalytic reforming unit 50. The process can include passing a heavy stream generated from other process units, such as a heavy cracker stream, wherein the heavy cracker stream comprises C7 and heavier hydrocarbons and is passed to the reforming unit 50. The reforming unit is preferably a continuous catalytic reforming unit wherein the catalyst is in a moving bed, and the catalyst is cycled through the reactor to a regenerator for regenerating the catalyst. This provides for a continuous process.

In the process for increasing the aromatics yields from the reforming unit 50, the process includes maintaining a substantially constant flow, while changing the feed composition to increase the aromatics yields. The process includes passing a straight run naphtha feed stream 8 to a naphtha splitter 10 to generate a heavy bottoms stream 14. The heavy bottoms stream 14 is passed to a hydrotreating unit 20 to generate a treated heavy stream 22. The treated heavy stream 22 is passed to an adsorption separation unit 30 to separate out normal hydrocarbons from the treated heavy stream 22. The normal hydrocarbons are passed out in an extract stream 32, and the adsorption separation unit 30 generates a raffinate stream 34 comprising non-normal hydrocarbons. The raffinate stream 34 is passed to the catalytic reforming unit 50. The non-normal hydrocarbons more readily reform to aromatics compounds over the normal hydrocarbons, and the change in feed composition to the reforming unit 50 increases the aromatics yields without increasing the feed flowrate.

The process utilizes an adsorption separation process for separating the hydrocarbon feedstream that is split and passed to a cracking unit and a reforming unit. The typical feedstream is a naphtha feedstream, and the performance of both the cracking unit and the catalytic reforming unit are improved. The adsorption separation unit separates normal paraffins from the non-normal paraffins. The non-normal components include branched paraffins, naphthenes and aromatics. The process preferably utilizes a naphtha splitter to separate out the light components that include C5-components in the naphtha. The C5-components are removed from the naphtha prior to passing the naphtha to the reformer, since the C5-components are not capable of being converted into aromatics.

The straight run naphtha can be fed to the naphtha stripper with a lighter component hydrocarbon to facilitate the stripping of the naphtha of the C5-components. The straight run naphtha has been hydrotreated, and can then be passed to the reforming unit. The hydrotreatment removes sulfur and other impurities that can act as poisons to catalysts in downstream processing units.

One aspect of this process is to change the distribution of hydrocarbons that are fed to the cracking unit and the reforming unit. The change in feed distribution enhances the performance of both the cracking unit and the reforming unit. Instead of the standard practice of splitting the naphtha to a C5-, one improvement is to adjust the splitter to include in the overhead stream of the naphtha splitter 10, additional components that are difficult to reform. Additional components in the overhead include dimethylbutanes, methylpentanes, normal hexanes and methyl cyclopentane (MCP). These additional components are passed to the cracking unit 40. By removing these components from the heavy bottoms stream, the subsequent stream passed to the reforming unit enhances aromatics yields.

A further aspect of this process is an additional separation of the heavy bottoms stream. Additional components that are also more difficult to reform, but are more readily cracked to light olefins include heavier normal paraffins. The adsorption separation system allows for the separation of normal paraffins that not readily separated by fractionation. The normal components are then passed to the cracking unit, and the non-normal components are passed to the reforming unit.

One aspect of the present process is the optimization of yields for a cracking unit and a reforming unit. The cracking unit and reforming unit can have been designed and sized for a predetermined flow of a naphtha feedstream. The addition of the naphtha splitter and the adsorption separation unit allows for shifting the compositions of the feeds to the cracking unit and the reforming unit, while maintaining substantially constant flows to the two units.

In one embodiment, the process for optimizing the production of downstream operations in the production of light olefins and aromatics includes a process for optimization of the production of aromatics and light olefins through the selective separation of hydrocarbon components from a hydrocarbon stream. The process includes passing a first hydrocarbon stream 8 to a first separation column 10 to generate a first light stream 12 and a first heavy stream 14. The first heavy stream 14 is passed to a hydrotreating unit 20 to generate a treated heavy stream 22. The treated heavy stream 22 is passed to a second separation unit 30 to generate an extract stream 32 and a raffinate stream 34. The extract stream 32 and the first light stream 12 are passed to a cracking unit 40. In order to maintain a constant flow to the cracking unit 40, the extract stream 32 and the first light stream 12 are supplemented with a second hydrocarbon stream 6 passed to the cracking unit 40. The raffinate stream 34 is passed to a catalytic reforming unit 50 to generate a process stream 52 with increased aromatics content.

The typical hydrocarbon stream used for cracking is a naphtha stream, and the first hydrocarbon stream and the second hydrocarbon stream can be a straight run naphtha, and the streams can be generated by a splitting of the straight run naphtha. In one embodiment, the second hydrocarbon stream can be a light naphtha stream, that can be generated during the production of the naphtha streams. The process and flow rates are adjusted to maintain substantially constant flow rates to the cracking unit, and to the catalytic reforming unit. This control is facilitated by the split of the first and second hydrocarbon streams, wherein the second hydrocarbon stream 6 can be reduced or increased in response to the amount of the first light stream 12 generated by the first separation column 10 and the amount of the extract stream 32 generated by the second separation unit 30.

The process can further include an upstream separation unit to take the straight run naphtha and make a course splitting with a light naphtha stream and a remaining naphtha stream.

The raffinate stream is passed to a catalytic reforming unit, where the raffinate stream has had normal paraffins removed. The raffinate stream can be used as a downstream blending stream for gasoline or other product. It is preferred that the raffinate stream is passed to the catalytic reforming unit to increase the yields of aromatics, with the reforming unit product stream passed to an aromatics complex.

The optimization process generates the first light stream from the first separation column 10. The first light stream comprises C5-components from the naphtha stream as they are not readily reformable to aromatics. It has also been found that the first separation column 10 is operated to send some C6 components out with the light overhead stream 12. These components include methyl cyclopentane (MCP), normal hexane, methyl pentanes, and dimethylbutanes. For processes where cracking generates a heavy cracked stream, wherein the components have a substantial amount of C7 hydrocarbons, the heavy cracked stream can be passed to the reforming unit.

An example provides for an illustration of the improvements achievable through this process.

TABLE results from simulations

| case | lt. olefins yield | Reformate aromatics (%) | SR naphtha feed to cracker (KMTA) |
|---|---|---|---|
| Base case | 590.8 | | 1370 |
| C5- cut, no $2^{nd}$ sep. | 609.1 | 55.36 | 1210 |
| MCP cut, no $2^{nd}$ sep. | 641.6 | 60.75 | 792 |
| C5- cut, $2^{nd}$ sep. | 731.7 | 58.38 | 773 |
| MCP cut, $2^{nd}$ sep. | 747.8 | 63.27 | 329 |

The simulations are based upon information from the unit operations. The cases assume a constant straight run (SR) naphtha feed of 1370 KMTA to the cracking unit. The SR naphtha was split and a constant flow to the cracking unit was maintained, with decreasing the amount of SR naphtha to the cracking unit as light ends from the first separation column were increased and the extract from the second separation unit was increased. The remainder is directed to the catalytic reforming unit.

As can be seen from the results, the light olefin yields increase significantly over the base case, and the improvement with the second separation unit is even more substantial. Also, as can be seen from the aromatics yields, the addition of the second separation unit increases the amount of hydrocarbons converted to aromatics. In addition, the results indicated that for maintaining a constant RONC (research octane number) for the aromatics generated by the reforming unit, the amount of catalyst can be reduced, thereby providing for a significant savings in capital and operating costs.

While the invention has been described with what are presently considered the preferred embodiments, it is to be understood that the invention is not limited to the disclosed embodiments, but it is intended to cover various modifications and equivalent arrangements included within the scope of the appended claims.

Specific Embodiments

While the following is described in conjunction with specific embodiments, it will be understood that this description is intended to illustrate and not limit the scope of the preceding description and the appended claims.

A first embodiment of the invention is a process for optimizing the production of downstream operations in the production of light olefins and aromatics, comprising passing a first hydrocarbon stream to a first separation column to generate a first light stream and a first heavy stream; passing the first heavy stream to a hydrotreating unit to generate a treated heavy stream; passing the treated heavy stream to a second separation unit to generate an extract stream and a raffinate stream; passing the extract stream, the first light stream and a second hydrocarbon stream to a cracking unit; and passing the raffinate stream to a catalytic reforming unit. An embodiment of the invention is one, any or all of prior embodiments in this paragraph up through the first embodiment in this paragraph wherein the first hydrocarbon stream is a straight run naphtha stream. An embodiment of the invention is one, any or all of prior embodiments in this paragraph up through the first embodiment in this paragraph wherein the second hydrocarbon stream is a light naphtha stream. An embodiment of the invention is one, any or all of prior embodiments in this paragraph up through the first embodiment in this paragraph wherein the second hydrocarbon stream is a straight run naphtha stream. An embodiment of the invention is one, any or all of prior embodiments in this paragraph up through the first embodiment in this paragraph wherein the total flow to the cracking unit is held constant. An embodiment of the invention is one, any or all of prior embodiments in this paragraph up through the first embodiment in this paragraph further comprising splitting a straight run naphtha stream into the first hydrocarbon stream and the second hydrocarbon stream.

A second embodiment of the invention is a process for optimizing the composition of hydrocarbon streams to improve the performance of downstream operations comprising passing a hydrocarbon stream to a first separation column to generate a first light stream, and a first heavy stream; passing the first heavy stream to a hydrotreating unit, to generate a treated heavy stream; passing the treated heavy stream to second separation unit to generate a first extract stream comprising normal hydrocarbons, and a raffinate stream comprising non-normal hydrocarbons; and passing the first light stream and the first extract stream to a cracking unit to generate light olefins. An embodiment of the invention is one, any or all of prior embodiments in this paragraph up through the second embodiment in this paragraph wherein the raffinate stream is used as finished gasoline product or a gasoline blending stream. An embodiment of the invention is one, any or all of prior embodiments in this paragraph up through the second embodiment in this paragraph further comprising passing the raffinate stream to a catalytic reforming unit. An embodiment of the invention is one, any or all of prior embodiments in this paragraph up through the second embodiment in this paragraph wherein the first light stream comprises C5-hydrocarbons. An embodiment of the invention is one, any or all of prior embodiments in this paragraph up through the second embodiment in this paragraph wherein the first light stream comprises methyl cyclopentane and lighter hydrocarbons. An embodiment of the invention is one, any or all of prior embodiments in this paragraph up through the second embodiment in this paragraph wherein the first light stream comprises cyclohexane and lighter products An embodiment of the invention is one, any or all of prior embodiments in this paragraph up through the second embodiment in this paragraph wherein the cracking unit generates a cracker residual stream, and further comprising passing the cracker residual stream to a reforming unit. An embodiment of the invention is one, any or all of prior embodiments in this paragraph up through the second embodiment in this paragraph wherein the cracking unit is a catalytic cracking unit. An embodiment of the invention is one, any or all of prior embodiments in this paragraph up through the second embodiment in this paragraph wherein the cracking unit is a steam cracking unit. An embodiment of the invention is one, any or all of prior embodiments in this paragraph up through the second embodiment in this paragraph wherein the hydrocarbon stream is a straight run naphtha stream. An embodiment of the invention is one, any or all of prior embodiments in this paragraph up through the second embodiment in this paragraph wherein the hydrocarbon stream is a cracked naphtha stream. An embodiment of the invention is one, any or all of prior embodiments in this paragraph up through the second embodiment in this paragraph wherein the second separation unit is an adsorption separation unit.

A third embodiment of the invention is a process for increasing the aromatics content of a reformate stream, comprising passing a hydrocarbon stream to a splitter column to generate an overhead stream comprising light hydrocarbons, and a bottoms stream comprising heavy hydrocarbons; passing the bottoms stream to a hydrotreating unit to generate a treated heavy stream; passing the treated heavy stream to a separation unit to generate an extract stream comprising normal hydrocarbons and a raffinate stream comprising non-normal hydrocarbons; and passing the raffinate stream to a catalytic reforming unit to generate a process stream having increased aromatics content. An embodiment of the invention is one, any or all of prior embodiments in this paragraph up through the third embodiment in this paragraph wherein the hydrocarbon stream is a straight run naphtha stream. An embodiment of the invention is one, any or all of prior embodiments in this paragraph up through the third embodiment in this paragraph wherein the splitter column is a naphtha splitter column, and the overhead stream comprises C6 and lighter hydrocarbons, and the bottoms stream comprises C7 and heavier hydrocarbons. An embodiment of the invention is one, any or all of prior embodiments in this paragraph up through the third embodiment in this paragraph further comprising passing the overhead stream to a cracking unit. An embodiment of the invention is one, any or all of prior embodiments in this paragraph up through the third embodiment in this paragraph wherein the cracking unit is a catalytic naphtha cracker, or a naphtha steam cracker. An embodiment of the invention is one, any or all of prior embodiments in this paragraph up through the third embodiment in this paragraph further comprising splitting the naphtha feedstream to a first portion and a second portion, and passing the first portion to the cracking unit, and passing the second portion to the splitter column. An embodiment of the invention is one, any or all of prior embodiments in this paragraph up through the third embodiment in this paragraph further comprising operating the splitter column and the separation unit to maintain a constant mass flow to the catalytic reforming unit.

A fourth embodiment of the invention is a process for increasing the aromatics content of a reformate stream and increasing the light olefins yields from a cracking unit, comprising passing a hydrocarbon stream to a splitter column to generate an overhead stream comprising light hydrocarbons, and a bottoms stream comprising heavy hydrocarbons; passing the bottoms stream to a hydrotreating unit to generate a treated heavy stream; passing the treated heavy stream to a separation unit to generate an extract stream comprising normal hydrocarbons and a raffinate stream comprising non-normal hydrocarbons; passing the overhead stream and the extract stream to a cracking unit; and passing the raffinate stream to a catalytic reforming unit to generate a process stream having increased aromatics content. An embodiment of the invention is one, any or all of prior embodiments in this paragraph up through the fourth embodiment in this paragraph wherein the cracking unit is a catalytic naphtha cracker. An embodiment of the invention is one, any or all of prior embodiments in this paragraph up through the fourth embodiment in this paragraph further comprising splitting the naphtha feedstream to a first portion and a second portion, and passing the first portion to the cracking unit, and passing the second portion to the splitter column.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for optimizing the production of downstream operations in the production of light olefins and aromatics, comprising:

passing a first hydrocarbon stream to a first separation column to generate a first light stream comprising methylcyclopentane, n-hexane, methyl-pentanes, dimethylbutane, and $C_5$-hydrocarbons and a first heavy stream comprising cyclohexane, and C7+ heavier hydrocarbons;

passing the first heavy stream to a hydrotreating unit to remove sulfur and other catalyst poisonous impurities to generate a treated heavy stream;

passing the treated heavy stream to a second separation unit to generate an extract stream comprising heavier normal paraffins and a raffinate stream comprising cyclohexane, branched paraffins, naphthenes, aromatics;

passing the extract stream, the first light stream and a second hydrocarbon stream to a cracking unit, wherein the total flow to the cracking unit is held constant; and passing the raffinate stream to a catalytic reforming unit to produce a product with an increased amount of aromatics.

2. The process of claim 1 wherein the first hydrocarbon stream is a straight run naphtha stream.

3. The process of claim 1 wherein the second hydrocarbon stream is a light naphtha or a straight run stream.

4. The process of claim 1 further comprising splitting a straight run naphtha stream into the first hydrocarbon stream and the second hydrocarbon stream.

* * * * *